US006408864B1

(12) United States Patent
Brunson et al.

(10) Patent No.: US 6,408,864 B1
(45) **Date of Patent: *Jun. 25, 2002**

(54) SILO TYPE STORAGE TANK WITH CLEAN-IN-PLACE SPRAY OPENING HAVING CHAMFERED EDGE TRANSITION, AND ALTERNATE HELPER TUBE AND SPIKE

(75) Inventors: Jeffrey W. Brunson, Nixa; Kevin W. Bartholomaus, Springfield, both of MO (US)

(73) Assignee: Paul Mueller Company, Springfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/426,468

(22) Filed: Oct. 26, 1999

Related U.S. Application Data

(63) Continuation-in-part of application No. 09/392,863, filed on Sep. 9, 1999.

(51) Int. Cl.[7] ..... B08B 3/02

(52) U.S. Cl. ..... 134/166 R; 134/168 R; 134/169 R; 134/201

(58) Field of Search ..... 134/166 R, 167 R, 134/167 C, 168 R, 169 C, 169 R, 168 C, 166 C, 201

(56) References Cited

U.S. PATENT DOCUMENTS 3,031,148 A * 4/1962 Holdren
3,655,245 A * 4/1972 Schumacher
3,953,226 A * 4/1976 Emond et al.
4,192,332 A 3/1980 Feldmeier
4,386,637 A * 6/1983 Buchanan et al.
4,764,221 A * 8/1988 Harteigsen et al.
5,301,702 A * 4/1994 McKinney
5,381,923 A 1/1995 O'Dea
5,538,038 A * 7/1996 Boytim et al.
5,594,973 A * 1/1997 Brusseleers et al.
5,649,338 A * 7/1997 Kato
5,660,214 A 8/1997 Pettesch

* cited by examiner

*Primary Examiner*—Frankie L. Stinson
(74) *Attorney, Agent, or Firm*—Thompson Coburn LLP; R. Haferkamp; J. Rolnicki

(57) ABSTRACT

A silo type storage tank includes a clean-in-place system comprising a flush opening having an edge transition located at about four and one half inches below the weld seam joining the tank top to the sidewall and fed by an upwardly angled channel in the tank sidewall arranged at approximately 23 degrees from the interior surface of the tank sidewall. The edge transition comprises a chamfer along most of the circumference with an undercut formed along the upper portion of said edge transition. Alternately, a second spray or "helper" tube may be provided that has its opening aligned to spray cleaning fluid immediately beneath the flush opening so that cleaning fluid flowing through the tank sidewall opening and the helper tube washes the entire interior surfaces of the tank. In still another embodiment, a spike may be provided in the spray path instead of a helper tube to divert the spray so that a complete clean-in-place function is achieved.

45 Claims, 9 Drawing Sheets

SILO TYPE STORAGE TANK WITH CLEAN-IN-PLACE SPRAY OPENING HAVING CHAMFERED EDGE TRANSITION, AND ALTERNATE HELPER TUBE AND SPIKE

CROSS REFERENCE TO RELATED APPLICATION

This application is a continuation-in-part of Ser. No. 09/392,863 filed Sep. 9, 1999 still pending.

BACKGROUND AND SUMMARY OF THE INVENTION

Silo type storage tanks are commonly used for containing foodstuffs during processing and/or storage. These tanks can be quite large, ranging from a little over eight feet to a little over twelve feet in diameter in a typical application, and up to a little over sixty feet tall. In order to meet sanitary standards set by a number of regulatory agencies, including 3-A and the USDA, it is necessary that all of their internal surfaces be amenable to being completely cleaned on a periodic basis. One prior art device that has been provided to accomplish this includes a spray nozzle and spray dish located at the top center of the tank, wherein the cleaning fluid sprays through the nozzle and is deflected off the spray dish and against the top and sidewalls to cascade the cleaning fluid down the tank surfaces to thereby clean them. A supply line carries the cleaning solution from the alcove, up the outside of the tank, through the top head, and onto the spray dish. This arrangement requires a ladder, cage, guardrail, and possibly a catwalk to gain access for maintenance and inspection, thus entailing an added layer of expense and inconvenience. In some applications this cleaning apparatus is removable, which then further increases the expense due to the need for ferrules, clamps, and gaskets to accommodate its disassembly/re-assembly. Another attempt in the prior art to address this cleaning problem is shown in U.S. Pat. No. 4,192,332 which discloses a jet spray nozzle located in the lower portion of the tank, extending inwardly from the alcove area. With this device, cleaning fluid is sprayed through spray nozzles at high pressure upwardly against the top and upper sidewalls of the tank so that it may cascade down and clean. This device is similar to a spray ball and requires high pressure and flow rates, all of which again increases the initial cost and on-going operating expense.

These various prior art attempts to solve the cleaning problem all suffer drawbacks which heretofore were unavoidable. They require in some cases significant structural devices (ladders, etc.) which are unsightly, costly, and entail some degree of risk for the workman who must inspect and maintain the cleaning system. Alternately, with the spray ball device, a rather complicated device must be provided which again represents a significant expense, and which itself must be removable from the tank for it to be cleaned and to avoid interference with the operation of the tank. Furthermore, there must be periodic inspection and maintenance. Neither of these approaches allow for the cleaning operation to be conducted automatically and without an operator getting physically involved at some point in time either for operation or maintenance.

In order to solve these and other problems in the prior art, and as disclosed and claimed in the parent cross referenced above, the inventor has succeeded in designing and developing a clean-in-place fixture for a silo type storage tank which is elegantly simple, which eliminates the need for operator intervention, which is self cleaning, which has no special structure requiring expensive manufacture or maintenance, and which effectively cleans all interior surfaces of the tank while remaining fixed in place and without interfering with the operation of the tank. Essentially, the invention disclosed in the parent comprises a channel, duct, tube, or other passageway which is located near the top of the tank and which has an "angle of attack" such that a spray emanating therefrom effectively sprays the tank top and virtually the entirety of the tank sidewalls. An overflow tube, which is preferably a vertically oriented standpipe, has its mouth located adjacent the channel outlet so that cleaning fluid overflows out of the tube and against the sidewall just beneath the channel outlet to wash the sidewall beneath it, as well as the outer surfaces of the overflow tube itself. The overflow tube thus cleans that small portion of the tank interior which may be missed by cleaning fluid spraying out of the channel.

The "angle of attack" and physical location for the channel may be readily determined in the field for any particular tank size and dimension. However, the inventors have determined that a particular location and "angle of attack" works well with a broad range of tank sizes, and thus represents his preferred embodiment as explained below. By "angle of attack" is meant that angular orientation of the channel with respect to the interior tank sidewall. The inventors have also determined a channel size as their preferred embodiment which will provide an effective cleaning using the expected flow rates and pressures that have been adopted in the industry. Thus the invention disclosed in the parent is readily adaptable to any existing or new installation without the need for extensive considerations of cleaning fluid pumps or supplies. It has also been determined that these factors are somewhat interrelated such that changing one may be accommodated for by changing another, and yet provide an effective cleaning. Therefore, there is some flexibility in the implementation of the invention disclosed in the parent which will allow for user or designer preference.

Thus, the invention disclosed in the parent represents a significant advance over the prior art by eliminating structural devices, thereby providing an elegantly simpler device at less cost, maintenance, and with greater flexibility in implementation.

As a further improvement over the prior art, the inventors have continued the development of the invention and has found that alternative fixtures are helpful in certain arrangements in efficiently cleaning a tank interior. In one such alternative embodiment, one or more helper tubes may be provided and configured to spray the area of the tank below the main spray opening in place of the overflow tube. These helper tubes may be oriented at any convenient place in the tank, and take any of several different shapes and sizes. For example, the helper tubes may be formed as additional orifices in the tank sidewall or top, such that no "tubes" per se are included in the tank. Alternatively, the helper tubes may be actual tubes which extend into the tank and which are directed to the area required to be sprayed. Although the tubes may be located adjacent the spray opening, they may also be located across the tank and at its other side which is the greatest possible distance to be spaced away from the spray opening. These tubes are referred to as helper tubes as they may be somewhat smaller in diameter than the main spray tube. As another variation, a second "full size" spray tube may be provided and oriented conveniently to divide up the respective areas of the tank between them. They may be positioned to each spray an area that includes the area beneath the other so that additional helper tubes would not be needed. As still another variation, a plurality of "main" spray tubes could be provided, with the tubes being spaced conveniently about the tank to clean an appropriate area. Still another feature that may be included to help disperse the spray is a spike arranged to be in the path of and generally concentric to the spray leaving the spray opening. This spike diverts just enough of the spray to clean the area of the tank below the spray opening. These arrangements can be used in various combinations, the concept being that the clean-in-place function which heretofore was thought of as being only possible with supplemental cleaning and spraying equipment is now for the first time accomplished with permanently installed spray tubes, openings, and diverters that do not interfere with the normal operation of the tank and which eliminate the need for operator access to the tank top or high sidewalls over catwalks and ladders.

In still further development of the present invention, the inventors have discovered that a single spray opening as described above except having a chamfered edge transition and top undercut to the tank sidewall will by itself clean the entire inside surfaces of a tank. This embodiment of the invention eliminates the requirement of any overflow tubes, helper tubes, spikes, etc. It is anticipated by the inventors that the chamfered transition and undercut may have alternate shapes or sizes and yet still be effective in dispersing the spray sufficiently to spray and clean the tank interior. These variations are considered by the inventors to be within the grasp of those of ordinary skill in the art without undue experimentation, given the teaching of the present disclosure. However, explained below is the inventors' preferred embodiment of a chamfered edge transition and undercut which has been found to achieve a complete cleaning.

While the principal advantages and features of the invention have been briefly explained above, a greater understanding of the invention may be attained by referring to the drawings and description of the preferred embodiment which follow.

DETAILED DESCRIPTION OF THE PREFERRED EMBODIMENT

Figure 1:
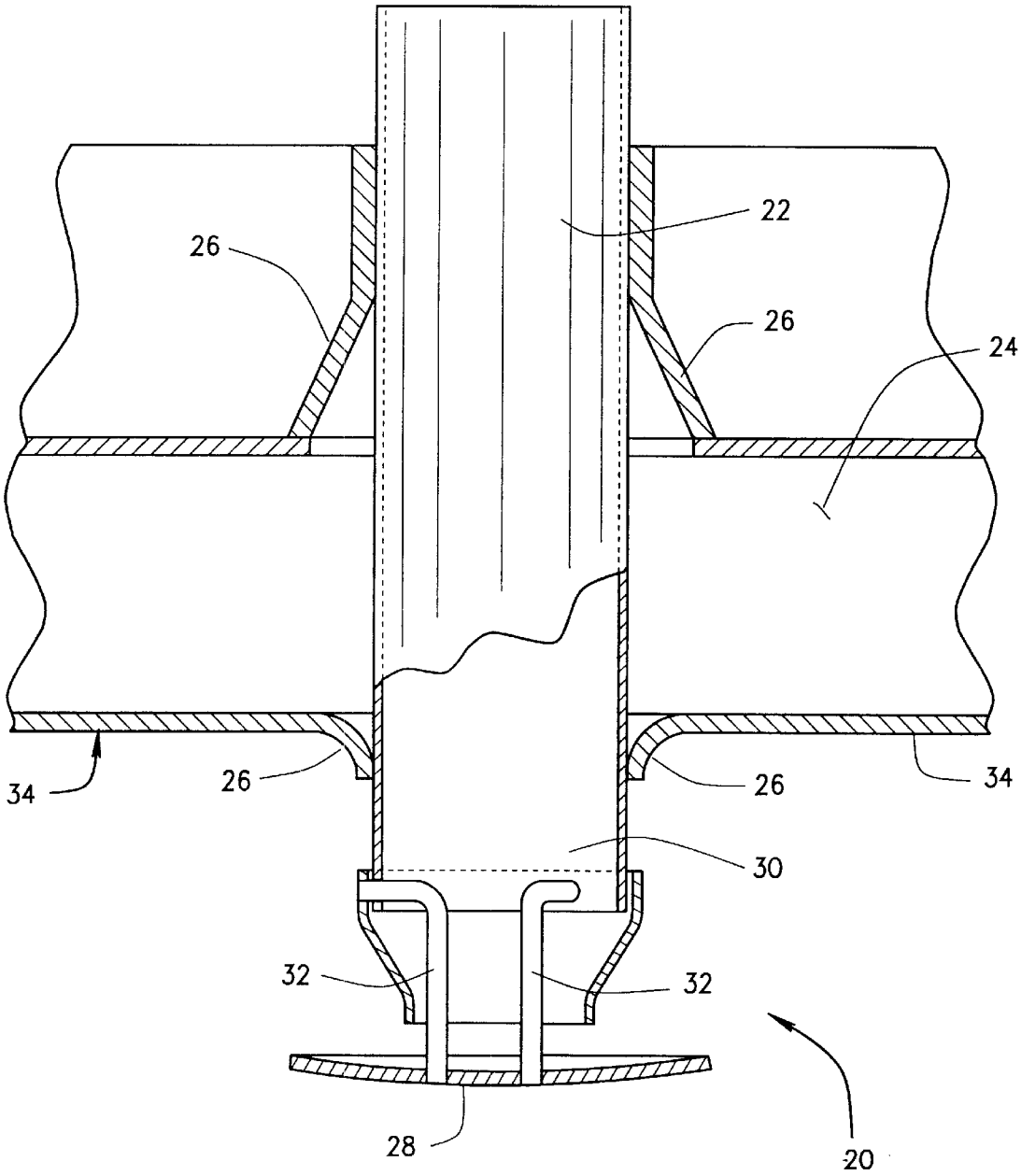
FIG. 1 PRIOR ART
FIG. 1 is a cross-sectional view of a prior art spray dish device used for cleaning a silo type storage tank.
Figure 2:
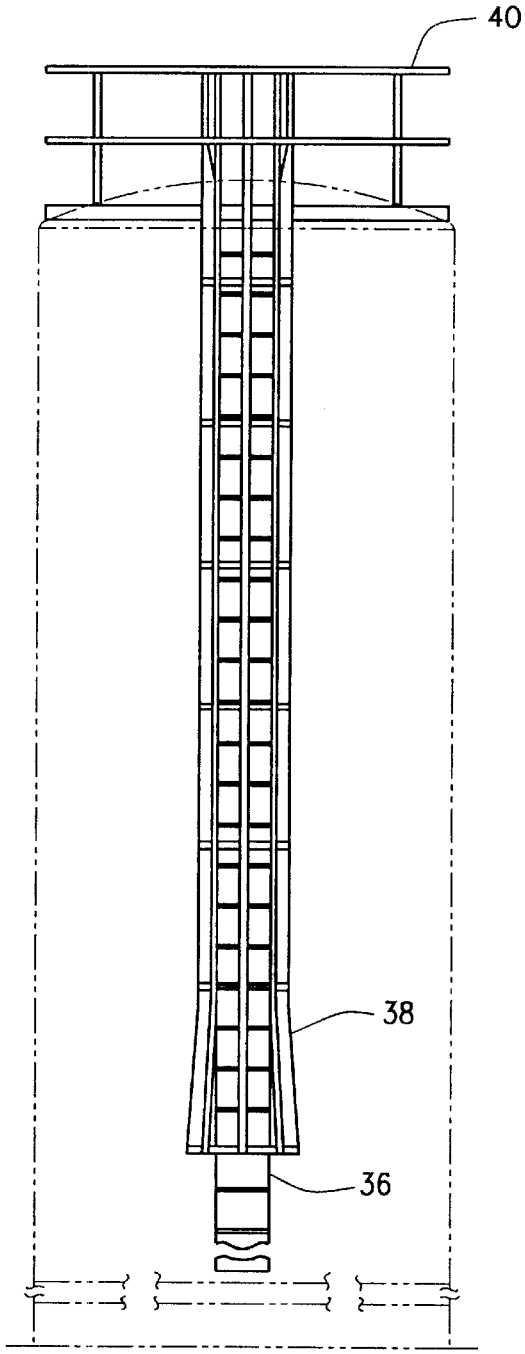
FIG. 2 PRIOR ART
FIG. 2 is a cross-sectional view of a prior art silo type storage tank with the necessary ladders, etc. as needed with the prior art cleaning device of FIG. 1.
Figure 3:
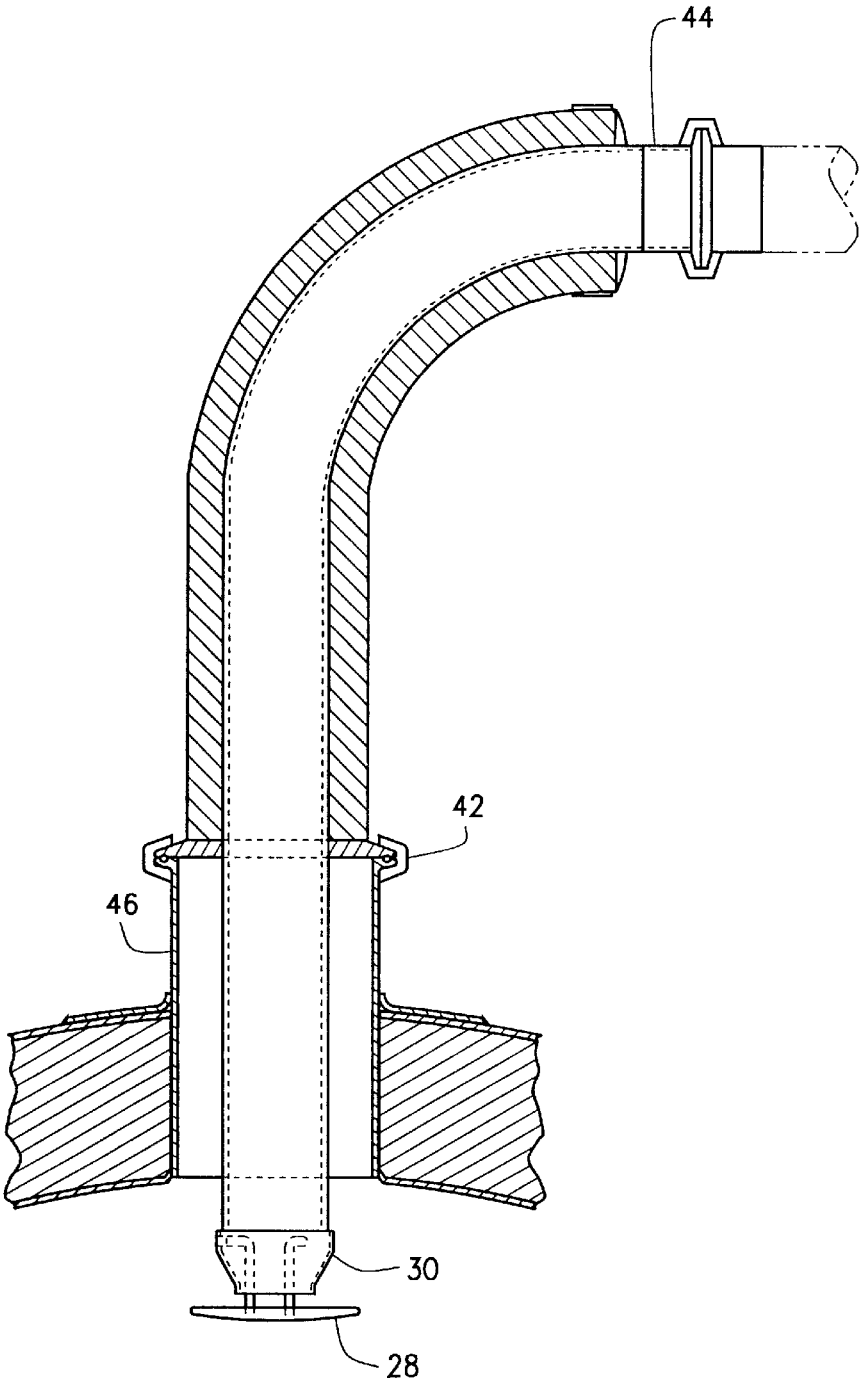
FIG. 3 PRIOR ART
FIG. 3 is a cross-sectional view of a prior art spray dish device used for cleaning a silo type storage tank that is also removable.
Figure 4:
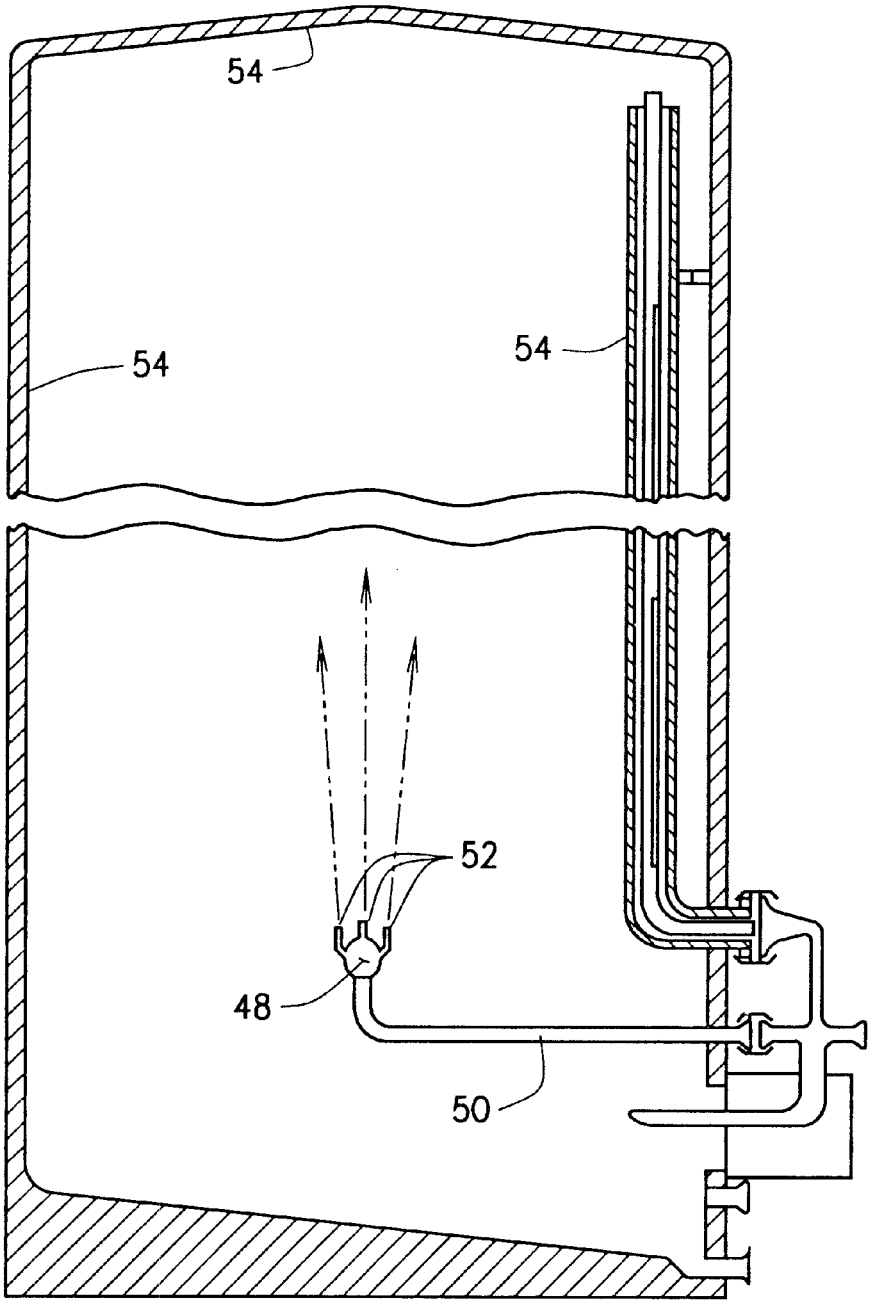
FIG. 4 PRIOR ART
FIG. 4 is a cross-sectional view of a second prior art device comprising a high pressure spray ball for cleaning a silo type storage tank.

As shown in FIG. 1, one type of prior art device 20 comprises a supply line 22 extending through the top 24 of the tank (not shown), and welded into place at 26. A spray dish 28 is attached to the lower end 30 of the supply line 22 by braces 32 with spray dish 28 being substantially arcuate in shape to deflect cleaning fluid upwardly and against the interior surfaces 34 of the tank top and which will then cascade down the sidewalls to clean the tank interior. As the prior art device 20 is mounted in the tank top 24, as shown in FIG. 2 a number of additional structural elements such as a ladder 36, cage 38, rail 40, etc. must be provided to allow for the inspection and maintenance of the spray dish 28 at the tank top 24. In some prior art installations, the spray dish 28 is removable as shown in FIG. 3. This requires a clamp 42 to seal a removable supply line 44 to a fitting 46 at the tank top 24, which is more complicated and costly. Still another prior art device is shown in FIG. 4 and includes a spray head 48 mounted at the end of a wand 50 with the spray head 48 having a plurality of high pressure spray nozzles 52 through which cleaning fluid is sprayed onto the tank interior 54. This apparatus must be periodically disassembled and thus is not only costly but also labor intensive.

Figure 5:
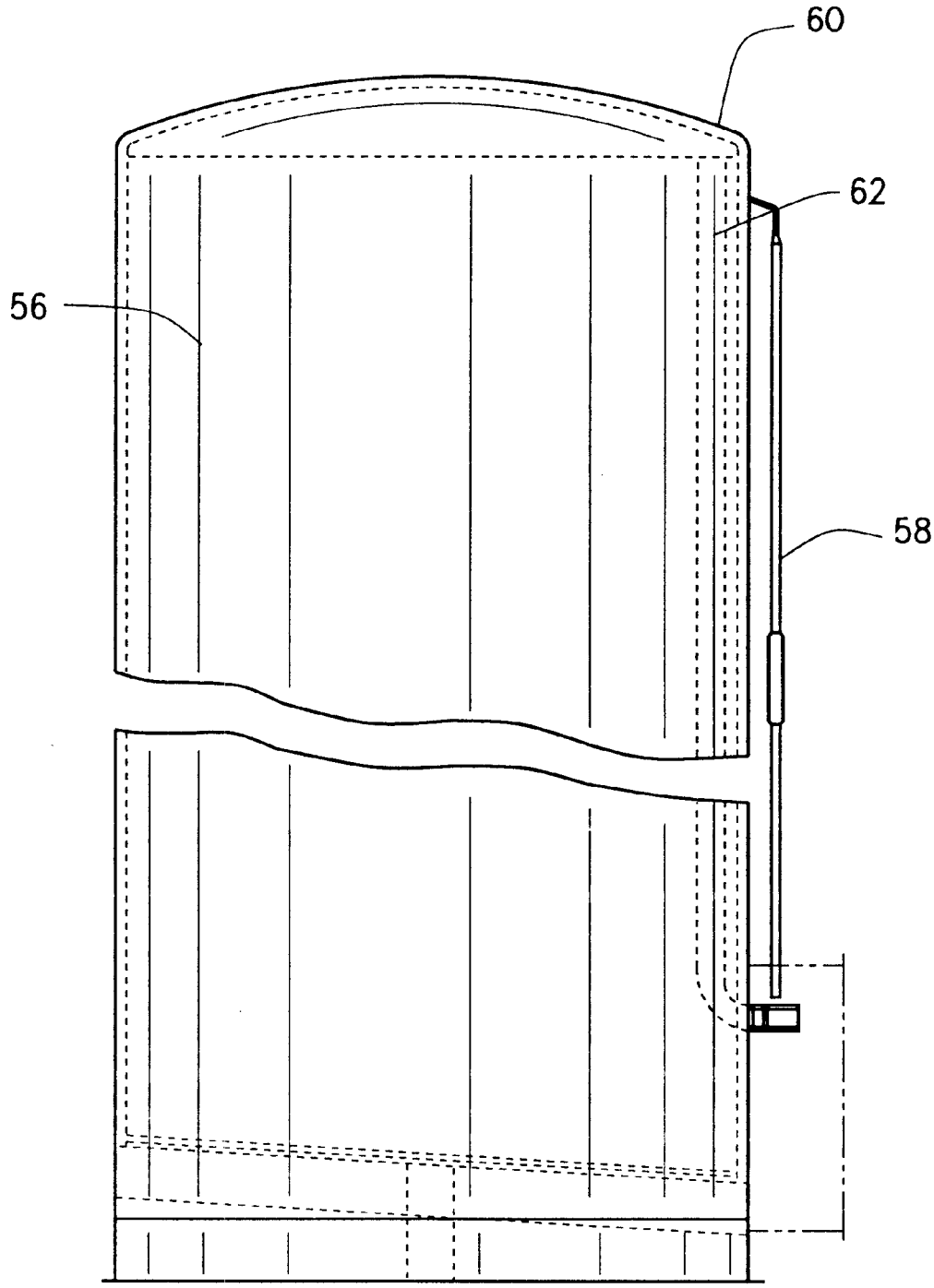
FIG. 5 is a cross-sectional view of the invention first disclosed in the parent comprising a silo type storage tank with a channel spray and overflow tube cleaning fixture.
Figure 6:
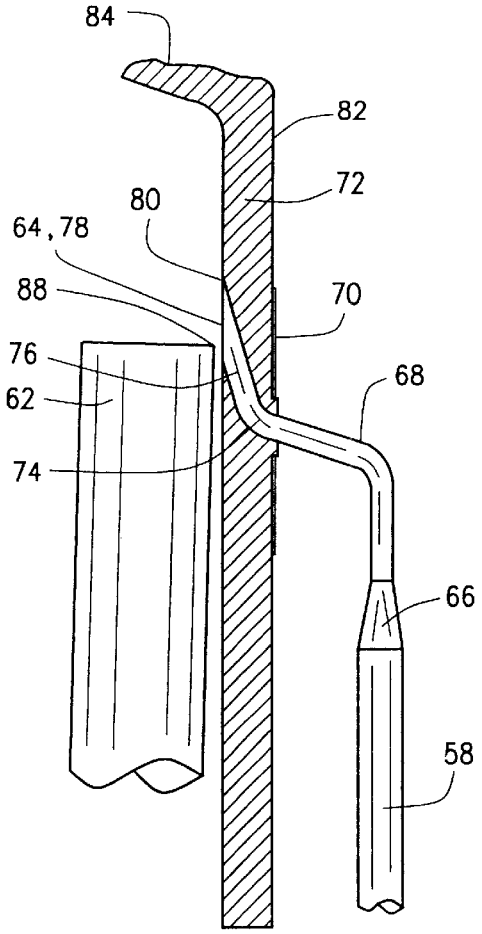
FIG. 6 is an enlarged partial cross-sectional side view of the channel and overflow tube cleaning fixture.
Figure 7:
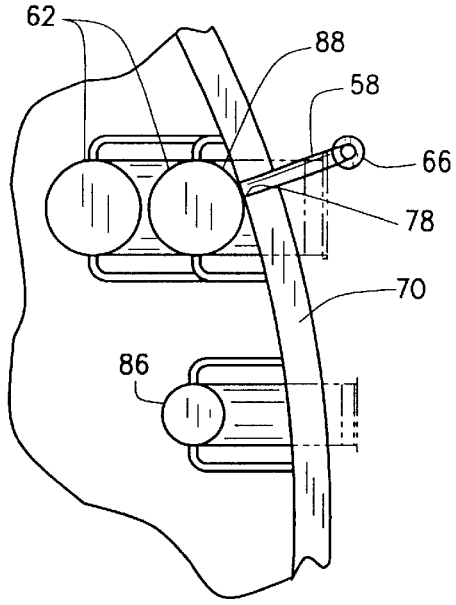
FIG. 7 is an enlarged partial cross-sectional top view of the channel and overflow tube cleaning fixture.
Figure 8:
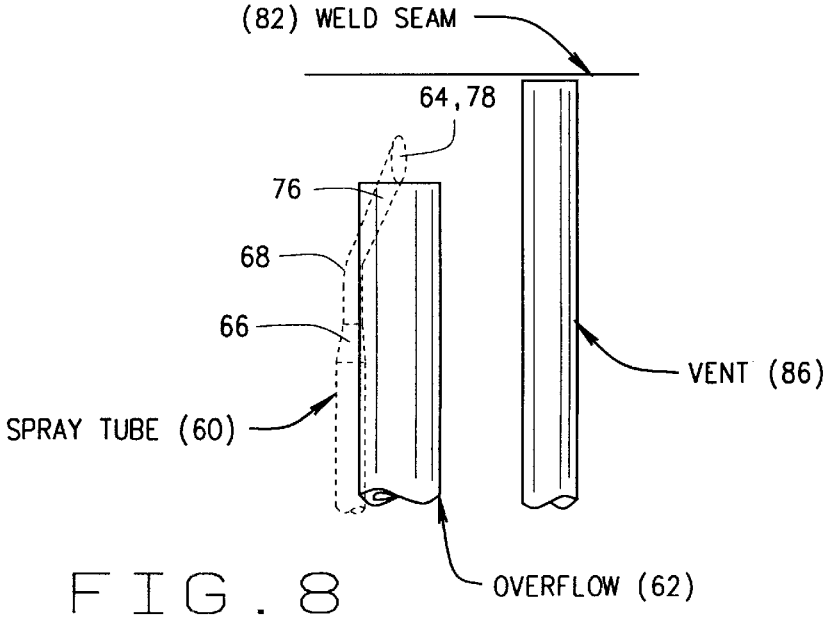
FIG. 8 is an enlarged view taken from the inside of the tank and detailing the channel opening.

The invention first disclosed in the parent is shown in FIG. 5 and includes a silo type storage tank 56 having a supply line 58 running vertically along the height of the tank 56 and entering the tank 56 near the top 60 of the tank, as well as an overflow tube 62 running vertically inside the tank 56 and up to a point just adjacent the spray opening 64 (see FIGS. 6 and 7). The clean-in-place system may also be provided separately or as a retrofit kit for adapting existing silo tanks. As shown in greater detail in FIGS. 6–8, the supply line 58 has a reducer 66 to neck down preferably to a nominal tube size of 0.87 inches ID before angling at elbow 68 for entry through a silicone escutcheon 70 into the tank sidewall 72. Inside the tank sidewall 72, the supply line 58 angles again at elbow 74 and forms a channel 76 which exits the interior tank sidewall 72 through an opening 78 which is preferably flush with the interior tank sidewall 72. As noted in FIG. 6, the centerline of channel 76 preferably forms an "angle of attack" with the interior surface of tank sidewall 72 of preferably approximately 23 degrees. Also as noted in FIG. 6, the upper edge 80 of opening 78 is preferably approximately four and one half inches from a weld scam 82 joining the tank sidewall 72 with the tank top 84. The opening 78 is preferably shaped as an ellipse, as the channel 76 is substantially circular in cross-section. However, the inventor has determined that the shape of opening 78 is not particularly important to achieving desirable spray coverage over the tank interior surfaces. With the preferred embodiment described above, a flow rate of 120 gpm at 70 psi divided into 90 gpm at 40 psi of cleaning fluid through the opening 78 and the balance of the flow divided substantially equally between the overflow tube 62 and a vent tube 86 also located within the tank 56 so that each has approximately 15 gpm at 0 psi at their tops has been found to adequately clean tanks of varying sizes ranging from a little over eight feet to a little over twelve feet in diameter. It is known in the prior art to pump water upwardly through a vent tube or the like such that the water does not spray out the top of the tube but merely cascades over the lip surface and flows evenly down the sidewalls, as is experienced at 0 psi at the top. However, it is not known in the prior art that this technique may be used to wash the tank sidewall surface beneath a spray opening as with the invention first disclosed in the parent. These parameters comprise the inventor's preferred embodiment of the parent invention. However, other combinations are believed to also work adequately as well and may be readily determined by one of ordinary skill in the art without undue experimentation.

As shown in greater detail in FIG. 7, the overflow tube 62 has a "crook" in it as it wends its way up from the bottom of the tank from where it enters, and is arranged to have its upper lip/opening 88 substantially aligned with and located approximately one fourth inch away from the lower lip of opening 78. This ensures that cleaning fluid flowing up and over the lip 88 will adequately wash the tank sidewall immediately beneath opening 78. It is also noted that overflow tube 62 is preferably substantially aligned along the same radial that opening 78 is located on. This again ensures that a uniform flow of cleaning fluid washes over and down the tank sidewall immediately beneath and on both sides of opening 78.

It should be noted that there are variations which may be made to the parent invention without departing from the spirit and scope thereof. For example, the channel may be formed by the supply line being welded at its point of entry into the tank sidewall and the channel separately formed within the tank sidewall, or the supply line may be continuous and fitted into the tank sidewall such that the channel is part of the supply line. Depending on the thickness of the tank sidewall, and other fabrication issues, one arrangement may be preferred over the other. Although the preferred embodiment depicts two elbows in the supply line/channel, this arrangement is shown as it renders fabrication easier by enlarging the entry angle for the supply line into the tank sidewall for easier welding. However, this is an accommodation for ease of fabrication and does not affect the operation of the cleaning system. These elbows could be eliminated and the cleaning system would work just as well. Various materials could be substituted for those disclosed herein, subject to good manufacturing and fabrication practices as would be well known to those of ordinary skill in the art. The combination opening/overflow tube arrangement could be positioned at varying positions about the circumference of the tank, and are preferably depicted to be located immediately above the alcove area of the tank for case in fabrication only. It is noted that the flow of cleaning fluid is unobstructed from the opening to the tank top and sidewall, although the overflow tube is oriented nearby and may provide the slightest of obstruction for what may be only a very small portion of the spray emanating from the opening. This is not meant to detract from the intended meaning when the word unobstructed is used. Instead, as will be described below in connection with another embodiment of the invention, a true obstruction may be incorporated into the combination for other reasons. It is further noted that the opening forms a sharp transition at the tank sidewall, although other transitions may work equally as well and would be considered as "flush" as there is no substantial protrusion at the opening which extends beyond the profile of the sidewall.

Figure 9:
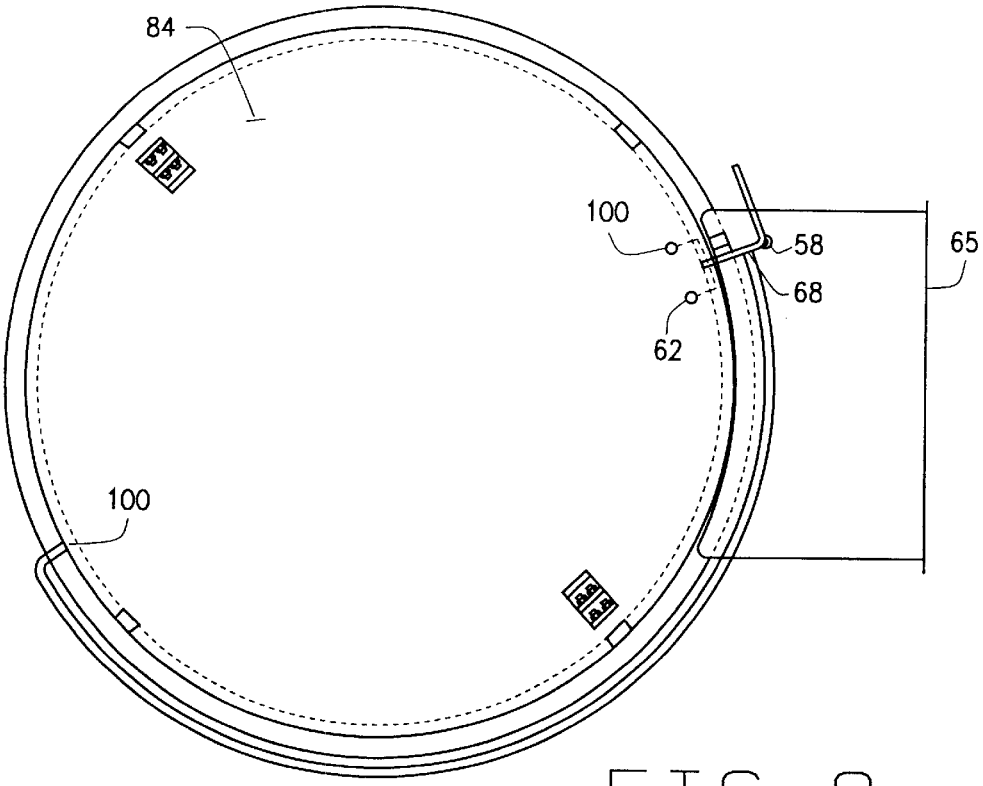
FIG. 9 is a top view of the tank with a helper tube located at the far side of the tank.
Figure 10:
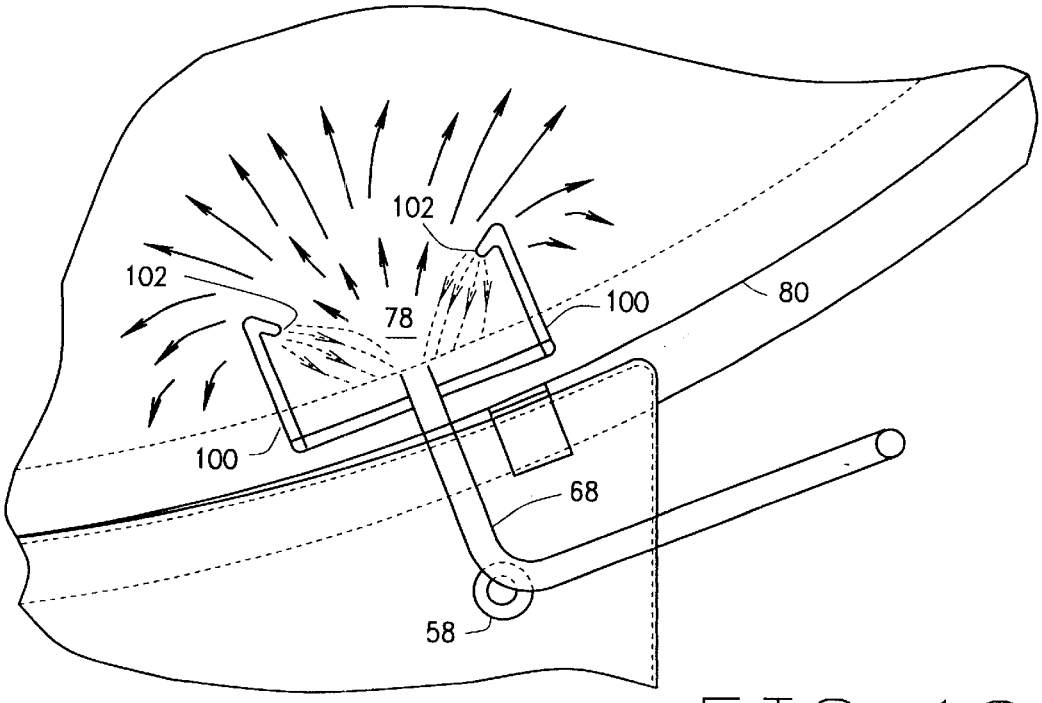
FIG. 10 is a detail view from FIG. 9 detailing a pair of helper tubes located near the spray opening.
Figure 11:
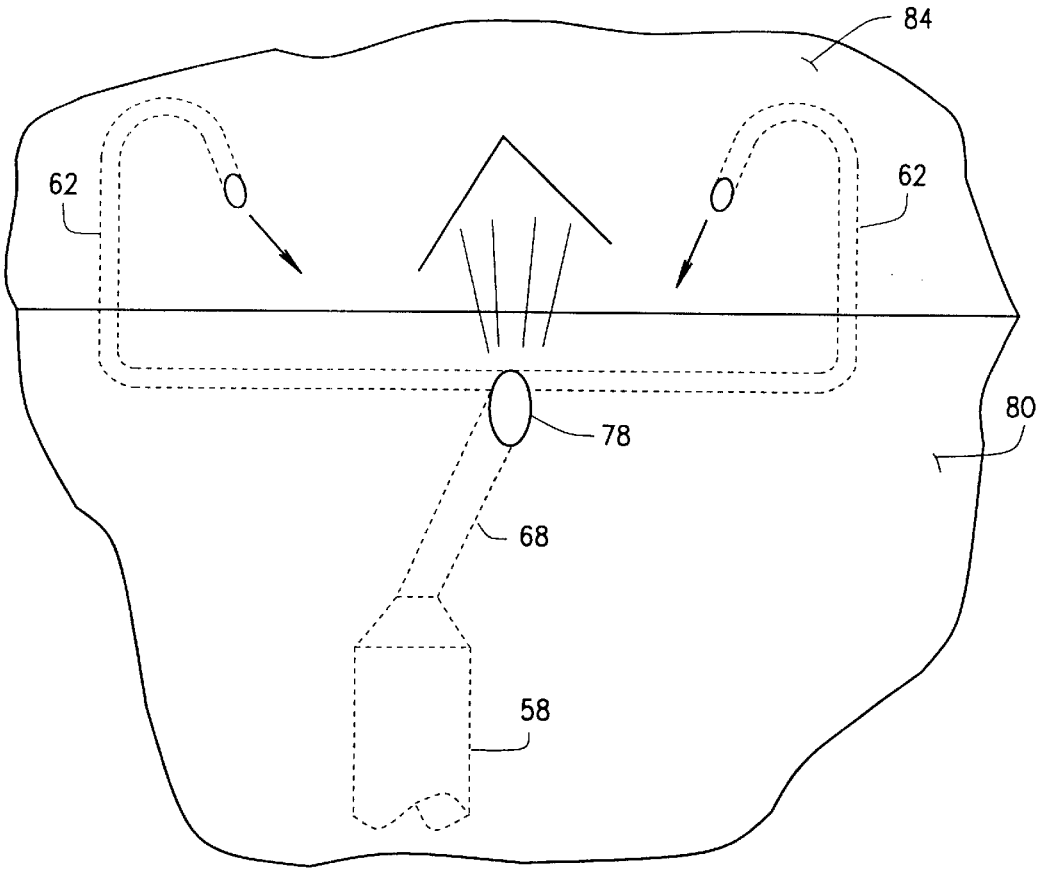
FIG. 11 is a partial side view of a tank with the helper tubes shown extending through the tank top near the spray tube opening.

Other embodiments of the invention are now shown in FIGS. 9–12 and allow for a clean-in-place system that doesn't require an overflow tube. As shown more particularly in FIGS. 9–11, one or more helper tubes 100 are preferably provided and can be positioned near the main spray opening 78 or across the tank at some angle to the spray opening. For example, as best shown in FIG. 9, the helper tubes may be even located at 180° from the spray tube and at that location may be provided with sufficient flow and pressure to effectively clean the area beneath the main spray opening 78. As shown in greater detail in FIG. 10, the helper tubes preferably extend into the tank through the tank top and comprise three eighth inch OD tubing which branches off of the channel 76 feeding the spray opening 78. The ends of the helper tubes are preferably positioned with their ends 102 approximately four and one half inches laterally from the spray opening 78. As shown in FIG. 11, the tubes are preferably provided with a radius of about three quarters of an inch and are positioned about four and one half inches above the tank sidewall, with the spray opening preferably positioned at about four and one half inches below the top of the tank sidewall. The angle of attack for the helper tubes is preferably 45° from vertical, as shown in FIG. 10. The preferred cleaning fluid flow for all of the main spray opening 78 and the helper tubes 100 is approximately 95 gpm±10 gpm at approximately 40 psi±5 psi. This flow has been found to be adequate to clean a tank having a 44,000 gallon capacity, with a nominal diameter of 140 inches. As shown in FIG. 9, the helper tube located at the far side of the tank could be thought of as a main spray tube, and the inventors contemplate that the spray tube or additional spray tubes could be positioned at various locations about the tank circumference and height to achieve the same clean-in-place function. The locations and sizes should be capable of determination by one of ordinary skill in the art without undue experimentation.

Figure 12A:
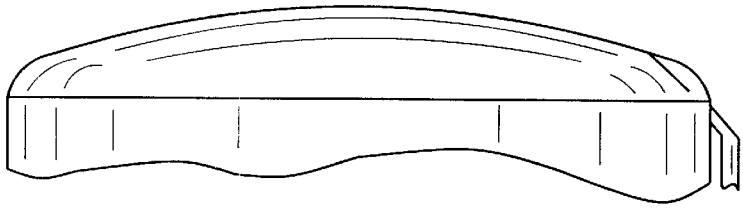
FIGS. 12(*a*) and (*b*) show the spike aligned generally with the spray opening for diverting the spray.
Figure 12B:
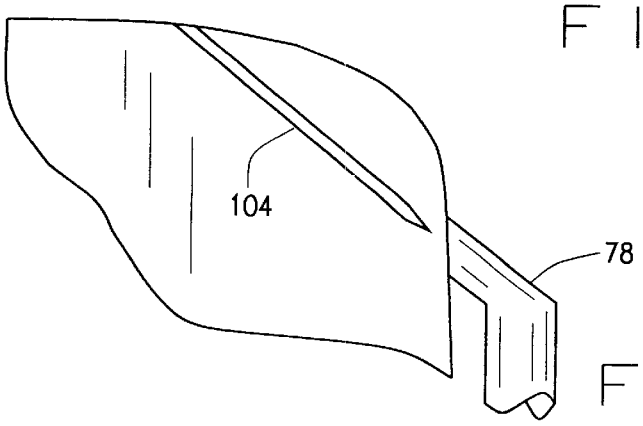

As shown in FIG. 12, a spike 104 which is preferably a three eighths inch diameter stainless steel spike may be placed in the spray path and divert enough cleaning fluid to clean the area of the tank below the spray opening 78. While the inventors preferred embodiment for the diverter is a spike, other shapes and sizes of a diverter may be used as would be apparent to one of ordinary skill in the art. The diverter 104 is preferably used in place of the helper tubes 100, although in some applications it may be desired to have both to ensure a reliable cleaning of all tank areas. As is appreciated by those of skill in the art, the provision of spike 104 or other diverter is substantially less expensive than the otherwise required cat-walks, ladders, etc. of the prior art that while not strictly necessary, it does not add significantly to the cost and provides "insurance" that a full and complete cleaning takes place even perhaps under reduced flow rates or pressures.

Figure 13:
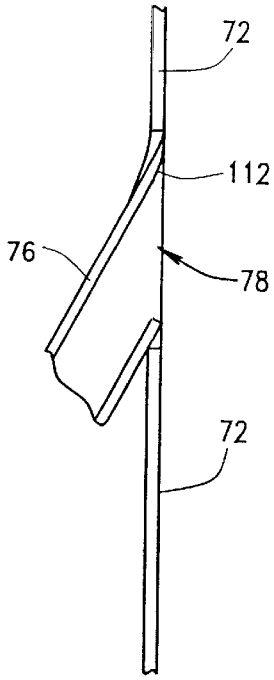
FIG. 13 is a partial cross sectional view of the spray tube welded into the sidewall of the tank.

While the foregoing embodiments of the invention have been found to be successful to achieve a reliable clean-in-place function, the inventors have continued their development and have found that by forming an edge transition in the spray opening, the spray opening 78 alone is successful in achieving a full clean. As shown in FIG. 13, a spray tube or channel 76 having a nominal OD of ⅞ inches is welded to the sidewall of the tank at approximately 23 degrees from vertical and at a nominal four and ½ inches from the weld seam near the top of the tank. As the spray tube or channel 76 is shaped as approximately a cylinder, as it transitions to the spray opening it would otherwise form an ellipse.

Figure 14:
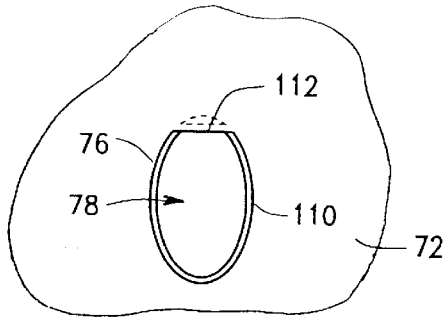
FIG. 14 is a front view of the spray tube opening detailing the edge chamfer and undercut formed in the spray tube transition.
Figure 15A:
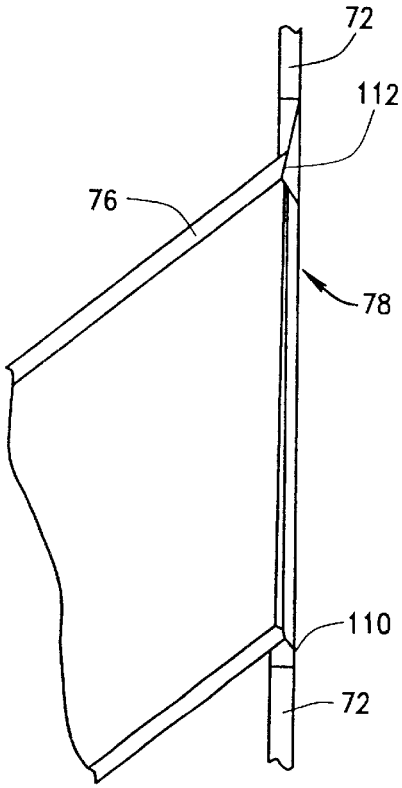
FIG. 15A is a cross sectional side view of the channel as it is welded into the tank sidewall.
Figure 15B:
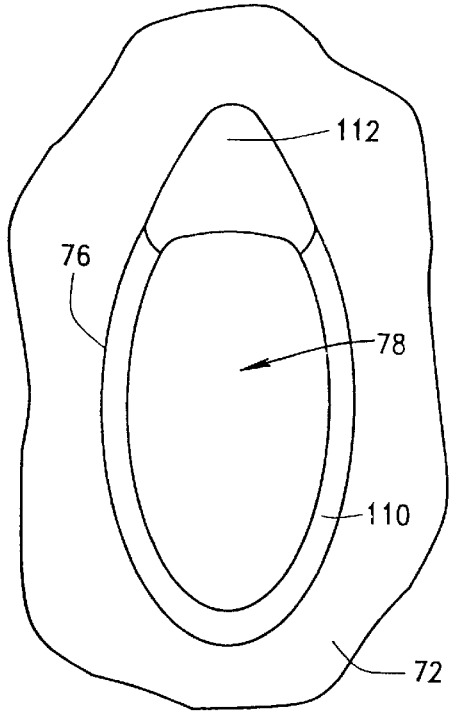
FIG. 15B is a front view of the spray tube opening of FIG. 15A.

However, as best shown in FIGS. 14, 15A and 15B an edge transition comprising a chamfer 110 of approximately ⅛ inches in width at an angle of approximately 45 degrees from the sidewall is formed around all but the uppermost circumference of the spray opening. Additionally, at the upper edge of the spray opening, an undercut 112 is filled in with a welding swage during fabrication to form a chord-like, sloped relief in the tank sidewall. During fabrication, the chamfer and undercut has been formed by grinding, and results in a sloped transition between the top of the channel and the sidewall immediately above. The inventors contemplate that the transition including a short length of channel may be cast and welded as a unit into the tank sidewall. The inventors also contemplate that the edge transition shall have rounded or curvilinear surfaces, and not necessarily sharp or angled edges, including at the line where the chamfer joins the sidewall and where it joins the channel. A radius, for example of one eighth inch, may be used to join the chamfer to the sidewall and the channel. This will ensure that the transition is properly formed and oriented. This undercut 112 is approximately ⅜ inches wide and approximately ¼ inches tall, and approximately halves the angle between it and the tank sidewall and the channel. Preferably, there is no chamfer 110 formed in the undercut 112. Thus, there is formed a "stepped" transition along the majority of the circumference of the spray opening 78, and a swage fills an upper chord to form an undercut 112 to complete the formation of the edge transition between the channel 76 and the sidewall 72. It would be appreciated by those of ordinary skill in the art that this method of forming the edge transition is convenient as the channel is welded to the tank during fabrication. However, other methods of forming the edge transition could be used as well. With this edge transition, the inventors have found that the spray opening will completely clean a tank interior with a cleaning fluid flow rate of 90 gpm at 45 psig without using any helper tubes, spikes, etc. It is anticipated by the inventors that "tweaking" could be done to the edge transition and yet still achieve a complete clean-in-place operation. Furthermore, having demonstrated that a single spray opening is successful in cleaning a tank, and without additional time to experiment before filing the present patent, the inventors anticipate that other spray openings could also be used successfully. Such tweaking is anticipated to achieve a complete cleaning of differently sized or shaped tanks. However, tweaking would be apparent and within the ordinary skill of those familiar with the art, and such modifications to the edge transition are intended to be included within the scope of the invention. In some instances, such tweaking may not be convenient in order to accommodate odd sized or shaped special order tanks and, in which event, it would be possibly more convenient to use helper tubes, spikes, etc. in order to reliably achieve a full and complete clean-in-place function. Thus, it is anticipated that several embodiments of the present invention would be useful in actual practice and in a commercial setting.

Still other changes and modifications would be apparent to one of ordinary skill in the art, and those changes and modifications are intended to be included in the scope of the invention which should be considered as limited only by the appended claims and their legal equivalents.

What is claimed is:

1. A silo type storage tank having a clean-in-place system for cleaning inside surfaces of said tank including its top and sidewalls, said system comprising an upwardly directed channel through the sidewall of said tank for spraying a cleaning fluid onto the inside top surface of the tank and at least one additional spray opening oriented to direct a cleaning fluid against the sidewall of the tank beneath the channel opening to thereby clean the sidewall below the channel opening.

2. The tank of claim 1 further comprising a supply line terminating at the tank sidewall, and wherein the channel is formed in said tank sidewall to extend between said supply line and the channel opening.

3. The tank of claim 1 further comprising a supply line extending through the sidewall to form the channel, the channel and supply line thereby comprising a continuous tube.

4. The tank of claim 1 wherein said channel opening is approximately four and one half inches below a weld seam joining the top to the tank sidewall, and the channel is in the shape of a tube oriented with its centerline at approximately 23 degrees from the tank sidewall.

5. The tank of claim 1 wherein the additional spray opening comprises a helper tube having a diameter smaller than that of the channel, and wherein said helper tube is oriented at approximately 45 degrees from vertical in a direction generally toward said channel.

6. The tank of claim 1 wherein said channel opening is substantially flush with the tank sidewall and with an upper edge thereof being located approximately four and one half inches below a weld scam joining the top to the tank sidewall, and the channel is substantially circular in cross-section with a diameter of approximately 0.87 inches.

7. The tank of claim 1 wherein the channel is oriented with its centerline at approximately 23 degrees from the tank sidewall.

8. A clean-in-place system for cleaning inside surfaces of a silo type storage tank including its top and sidewalls, said system comprising a supply line for forming at least part of an upwardly directed channel in the sidewall of said tank for spraying a cleaning fluid onto the inside top surface of the tank, and at least one helper tube for being oriented inside the tank to direct a cleaning fluid against the sidewall of the tank beneath the channel opening to thereby clean the sidewall below the channel opening.

9. The clean-in-place system of claim 8 wherein said supply line is adapted to extend through the sidewall to form the channel, said supply line and channel thereby comprising a continuous tube.

10. The clean-in-place system of claim 8 wherein said channel opening is formed with an upper edge located approximately four and one half inches below a weld scam joining the tank top to the tank sidewall, said supply line has a substantially circular cross-section with a diameter of approximately 0.87 inches, and the channel is adapted to be oriented with its centerline at approximately 23 degrees from the tank sidewall.

11. A silo type storage tank having a clean-in-place system for cleaning inside surfaces of said tank including its top and sidewalls, said system comprising a substantially flush opening formed in the tank sidewall for spraying a cleaning fluid onto at least the inside top surface of the tank and a second spray opening oriented inside the tank to direct a cleaning fluid against the sidewall of the tank beneath the opening to thereby clean the sidewall below the opening.

12. The storage tank of claim 11 wherein cleaning fluid sprayed through said opening is substantially unobstructed in its path to the tank top and sidewall.

13. The storage tank of claim 12 further comprising a duct through the tank sidewall communicating with said opening, the portion of said duct adjacent said opening being aligned with its centerline angled at approximately 23 degrees to the tank sidewall.

14. The storage tank of claim 13 wherein said opening is positioned with an upper edge thereof approximately four and one half inches below a joint between the tank sidewall and the tank top.

15. The storage tank of claim 14 wherein said second spray opening is substantially oriented at 45 degrees from vertical and pointed generally at the area of the tank sidewall immediately beneath the flush opening.

16. The storage tank of claim 15 wherein said duct has a substantially circular cross-sectional shape so that said opening is substantially elliptically shaped at the tank sidewall surface.

17. The storage tank of claim 16 wherein said second spray opening comprises at least one helper tube entering the tank through a top thereof, said helper tube being substantially circular in cross-section.

18. The storage tank of claim 17 further comprising a supply line communicating with said duct and wherein said duct is angled as it traverses said tank sidewall to thereby accommodate an entry angle substantially greater than 23 degrees for said supply line as it joins said duct at the tank outer sidewall.

19. The storage tank of claim 18 wherein said clean-in-place system is fixed in place in the storage tank, and not required to be moved for either cleaning or operation of the storage tank.

20. A silo type storage tank having a clean-in-place system for cleaning inside surfaces of said tank including its top and sidewalls, said system comprising an opening formed in the tank sidewall and configured for unobstructed spraying of a cleaning fluid onto at least the inside top surface of the tank and a diverter oriented inside the tank to direct some of the cleaning fluid exiting the opening against the sidewall of the tank beneath the opening to thereby clean the sidewall below the opening.

21. The storage tank of claim 20 wherein said diverter comprises a spike.

22. The storage tank of claim 21 wherein said spike is aligned to be substantially along the central axis of the opening, and mounted to the top of the tank so as to be spaced away from the opening.

23. A method for cleaning an inside of a silo type storage tank, including the tank top and sidewalls, comprising the steps of:

providing an upwardly directed duct having an opening substantially flush with the tank sidewall and near the tank top through which a cleaning fluid may be sprayed, providing a second spray opening through which a cleaning fluid may be sprayed and directed at the area immediately beneath the duct, and pumping a cleaning fluid through the duct and the second spray opening to thereby spray cleaning fluid against the inside of the tank top and sidewall to thereby clean them.

24. A silo type storage tank having a clean-in-place system for cleaning inside surfaces of said tank including its top and sidewalls, said system comprising an upwardly directed channel through the sidewall of said tank for spraying a cleaning fluid onto the inside surfaces of the tank, said channel extending upwardly as it extends through the tank sidewall.

25. A silo type storage tank having a clean-in-place system for cleaning inside surfaces of said tank including its top and sidewalls, said system comprising an upwardly directed channel through the sidewall of said tank for spraying a cleaning fluid onto the inside surfaces of the tank; and said channel transitions to said sidewall, said transition comprising a chamfered edge and undercut.

26. The silo tank of claim 25 wherein said channel is oriented at approximately 23 degrees from vertical.

27. The silo tank of claim 26 wherein said undercut is formed along an upper portion of said transition.

28. The silo tank of claim 27 wherein said chamfered edge is formed to approximately halve the angle between said chamfer and each of said sidewall and said channel.

29. The silo tank of claim 28 wherein no other spray openings are included in said clean-in-place system.

30. A silo type storage tank having a clean-in-place system for cleaning the inside surfaces of said tank including its top and sidewalls, said system comprising an upwardly directed channel through the sidewall of said tank for spraying a cleaning fluid onto the inside surfaces of the tank, said channel having an edge transition between said channel and said tank sidewall; and said edge transition comprises a chamfer.

31. The silo tank of claim 30 wherein said edge transition comprises an undercut formed along an upper portion of said edge.

32. The silo tank of claim 31 wherein said undercut has no chamfer.

33. The silo tank of claim 32 wherein said channel is oriented at approximately 23 degrees from vertical.

34. A silo type storage tank having a clean-in-place system for cleaning inside surfaces of said tank including its top and sidewalls, said system comprising an upwardly directed channel through the sidewall of said tank for spraying a cleaning fluid onto the surfaces of the tank, said channel having a flared opening at said sidewall.

35. The silo tank of claim 34 wherein said flared opening has a larger diameter than the diameter of said channel.

36. The silo tank of claim 35 wherein said opening is substantially asymmetrical about its circumference.

37. The silo tank of claim 36 wherein said opening is substantially elliptically shaped, and said channel is substantially cylindrically shaped.

38. The silo tank of claim 37 wherein said flared opening comprises a chamfer formed around at least a portion of a circumference of said opening.

39. The silo tank of claim 38 wherein said channel is oriented at approximately 23 degrees from vertical.

40. The silo tank of claim 39 further comprising an undercut formed along an upper edge of said opening.

41. A method for cleaning an inside of a silo type storage tank, including the tank top and sidewalls, comprising the steps of:

providing an upwardly directed duct having an opening substantially flush with the tank sidewall and near the tank top through which a cleaning fluid may be sprayed, and pumping a cleaning fluid through the duct to thereby spray cleaning fluid against the inside of the tank top and sidewalls to thereby clean them.

42. The method of claim 41 wherein said opening has and edge transition to said tank sidewalls and is oriented at approximately 23 degrees from vertical, said pumping step including pumping the cleaning fluid through said edge transition to thereby disperse the spray throughout the entirety of said tank.

43. The method of claim 42 wherein the step of pumping includes not pumping the cleaning fluid through any other spray opening.

44. The method of claim 41 further comprising providing a spike in the path of the cleaning fluid as it is sprayed from said opening.

45. The method of claim 41 further comprising the step of providing a spray tube, and wherein the pumping step includes the step of pumping cleaning fluid through said spray tube.

* * * * *